US011571062B1

(12) United States Patent
Huang

(10) Patent No.: US 11,571,062 B1
(45) Date of Patent: Feb. 7, 2023

(54) MULTIFUNCTIONAL COFFEE TABLE

(71) Applicant: Gangwei Huang, Guangdong (CN)

(72) Inventor: Gangwei Huang, Guangdong (CN)

( * ) Notice: Subject to any disclaimer, the term of this patent is extended or adjusted under 35 U.S.C. 154(b) by 0 days.

(21) Appl. No.: 17/529,285

(22) Filed: Nov. 18, 2021

(30) Foreign Application Priority Data

Sep. 26, 2021 (CN) ..... 202122332106.X

(51) Int. Cl.
*A47B 3/06* (2006.01)
*A47B 13/02* (2006.01)

(52) U.S. Cl.
CPC ..... *A47B 3/06* (2013.01); *A47B 13/02* (2013.01)

(58) Field of Classification Search
CPC .. A47B 13/02; A47B 3/06; A47B 3/12; A47B 91/003; A47B 2200/0011
See application file for complete search history.

(56) References Cited

U.S. PATENT DOCUMENTS

| | | | | |
|---|---|---|---|---|
| 2,324,252 | A * | 7/1943 | Woelfer | A47B 3/12 108/157.15 |
| 2004/0016376 | A1* | 1/2004 | Rivera | A47B 13/06 108/157.1 |
| 2016/0120302 | A1* | 5/2016 | Rassat | A47B 13/083 108/158.11 |
| 2018/0055218 | A1* | 3/2018 | Mueller | A47B 37/04 |
| 2019/0159588 | A1* | 5/2019 | Liao | A47B 13/003 |
| 2021/0219711 | A1* | 7/2021 | Lai | A47B 13/003 |

* cited by examiner

*Primary Examiner* — Daniel J Rohrhoff
(74) *Attorney, Agent, or Firm* — JCIP Global Inc.

(57) ABSTRACT

A multifunctional coffee table to meet the demands of being more comfortable and elegant. The present invention includes a table top, wherein several immediately adjacent frames are disposed under the table top to form a cylindrical frame body; a base is disposed at the bottom of the frames, and a fixing ring is disposed on the top of the frames and located between the table top and the frames; the frames are mountably connected with the base and with the fixing ring; and the table top covers the fixing ring. The coffee table of the present invention is composed of a storage frame with a table top.

10 Claims, 10 Drawing Sheets

MULTIFUNCTIONAL COFFEE TABLE

CROSS-REFERENCE TO RELATED APPLICATION

This application claims the priority benefit of China application No. 202122332106.X, filed on Sep. 26, 2021. The entirety of the above-mentioned patent application is hereby incorporated by reference herein and made a part of this specification.

BACKGROUND

Technical Field

The present invention relates to the field of household, and particularly to a coffee table with a storage or collection basket or frame.

Description of Related Art

Coffee table is one of relatively common furniture in life. The existing coffee table generally has only one coffee table top and several coffee table legs. Due to the limited size of the coffee table itself, there is little housing space and almost no housing function at all. Most coffee tables are common rectangular structures and used to hold items such as tea sets.

Most of the existing coffee tables are not detachable and simple in style. They take up much space during production and transportation and cannot be well stored when not in use. Particularly, during transportation and logistics processes, they take up a lot of space, and therefore, need to be improved.

SUMMARY

To solve the above problems, the present invention present invention provides a multifunctional coffee table. The combination of a detachable table top and a grid storage frame brings a new experience for home life to meet the demands of being more comfortable and elegant.

Specific technical solutions of the present invention present invention are as follows:

A multifunctional coffee table includes a table top, under which several immediately adjacent frames are disposed to form a cylindrical frame body, wherein a base is disposed at the bottom of the frames, and a fixing ring is disposed on the top of the frames, located between the table top and the frames and larger than the base. The frames are mountably connected with the base and with the fixing ring. The table top covers the fixing ring.

The frames include guard bars, transverse bars, a top plate, and a bottom plate, wherein the top plate is longer than the bottom plate, one or more longitudinally arranged guard bars are disposed between the top plate and the bottom plate, both ends of the guard bars are disposed on the top plate and the bottom plate respectively, the guard bars incline outwards and extend upwards from the bottom plate, and the inclination angle of the guard bars on the plane where the top plate is disposed is an acute angle.

One or more transversely arranged transverse bars are disposed between the top plate and the bottom plate, and the transverse bars are arranged to be parallel with the top plate and the bottom plate and disposed on the guard bars.

Further, frame body formed by the frames is a truncated cone frame body or trapezoidal table frame body.

Sidebars are disposed between ends of the top plate and the bottom plate of the frames, wherein the sidebars connect both ends of the top plate and the bottom plate, the inclination angle of the sidebars on the plane where the top plate is disposed is an acute angle, and the top plate and the bottom plate of the frames and the sidebars at both ends constitute a trapezoidal frame.

A table top is disposed on the top of the frames, wherein a downward cover ring is disposed on a bottom surface of the table top, and the cover ring of the table top is immediately adjacent to the fixing ring and the top of the frames.

The base has a central bottom shoe to form a plane and at least two uniformly distributed bottom rings formed outside the central bottom shoe, wherein several uniformly distributed radial supporting bars disposed between the bottom ring of the outermost end of the base and the central bottom shoe, and the central bottom shoe, the supporting bars, and the bottom ring of the base are disposed on the same plane.

Further, the truncated cone frame body formed by the frames is trapezoidal, an inner of the cover ring is larger than an outer wall of the top of the cylindrical frame body formed by the frames, and the inner wall of the cover ring of the table top is immediately adjacent to the fixing ring and the top of the frames.

The top plate and the bottom plate are arc-shaped and have the same central angle, the radian length of the top plate is greater than that of the bottom plate, and the inclination angle of the sidebars on the plane where the top plate is disposed is 77°~86°.

Planar projections of the transverse bars, the guard bars, and the sidebars are in the shape of #, the fixing ring and the base are circular, and the central bottom shoe is a circular ring or circular plate.

Further, the fixing ring and the base are square, the central bottom shoe is a square ring or square plate, the top plate, the sidebar, the transverse bar, and the guard bar constitute a right trapezoid, within which two connecting bars intersected are disposed, and four endpoints of the crossed connecting bars connect four corners of the right trapezoid.

Further, the fixing ring and the base are square, the central bottom shoe is a square ring or square plate, the top plate, the sidebar, the bottom plate, and the guard bar constitute a right trapezoid, within which two connecting bars intersected are disposed, four endpoints of the two connecting bars connect four corners of the right trapezoid, and the crossing point of the two connecting bars is disposed on the transverse bar.

Further, a bottom ring of an outer end of the base is provided with several second mounting holes, the bottom plate is provided with fourth mounting holes matched with the second mounting holes, the fixing ring is provided with several first mounting holes, and the top plate is provided with third mounting holes matched with the first mounting holes.

The fixing ring, the base, and the frames made of metal materials constitute a storage basket, with a table top made of composite boards, plastic materials or woods covered.

Further, the bottom surface of the table top is provided with an inner snap ring plate, which inclines downwards, smaller than the cover ring but larger than the base, and an obtuse angle is formed by an inner side of the inner snap ring plate and the bottom surface of the table top.

Further, the inclination angle of the guard bars on the plane where the top plate is disposed is 77°~86°.

The included angle between the inner side of the inner snap ring plate and the bottom surface of the table top is 94°~103°.

3 or 4 immediately adjacent circular-arc frames are disposed under the table top, and the central angle of the circular-arc frames is 120° or 90°.

The base includes 3~4 uniformly distributed bottom rings and 10~18 uniformly distributed supporting bars.

Further, an outer side of the table top is provided with a retainer that warps upwards, the cover ring of the bottom surface of the table top inclines downwards, the cover ring is smaller than the fixing ring, the perimeter of the cover ring is also less than that of the top of the truncated cone frame body formed by the frames, and an acute angle is formed by an inner wall of the cover ring and the bottom surface of the table top.

Further, an inner snap ring plate, which inclines downwards and smaller than the cover ring, is disposed under the table top, and an obtuse angle is formed by an inner side of the inner snap ring plate and the bottom surface of the table top.

The included angle between the inner wall of the cover ring and the bottom surface of the table top is 77°~86°, and the cover ring and the inner snap ring plate are several bumps separated from each other on an annulus.

A lower portion of the frame is provided with one to three transverse bars, an upper portion of the truncated cone frame body formed by the circular-arc frames is provided with 1~3 uniformly distributed circles, the diameters of the circles within the truncated cone frame body change gradually, and the circles abut against inner sides of the guard bars and uniformly distributed inside the upper portion of the truncated cone frame body formed by the frames.

The coffee table of the present invention is composed of a storage frame with a table top. It is convenient to be assembled and moved to hold books, photos, portable electronic products, plants, and other decorative accessories, also has a decorative storage space and suitable for use as a coffee table, a bedside table, or a storage basket to reduce space taken up during production and transportation. The frames, the base, and the fixing ring constitute the storage frame or collection basket. Solid metal grid frame provides good support for the table top. The coffee table is durable, light, and convenient to be placed near sofas and beds as well as in bathroom, balcony, etc. for use.

DESCRIPTION OF THE EMBODIMENTS

Figure 1:
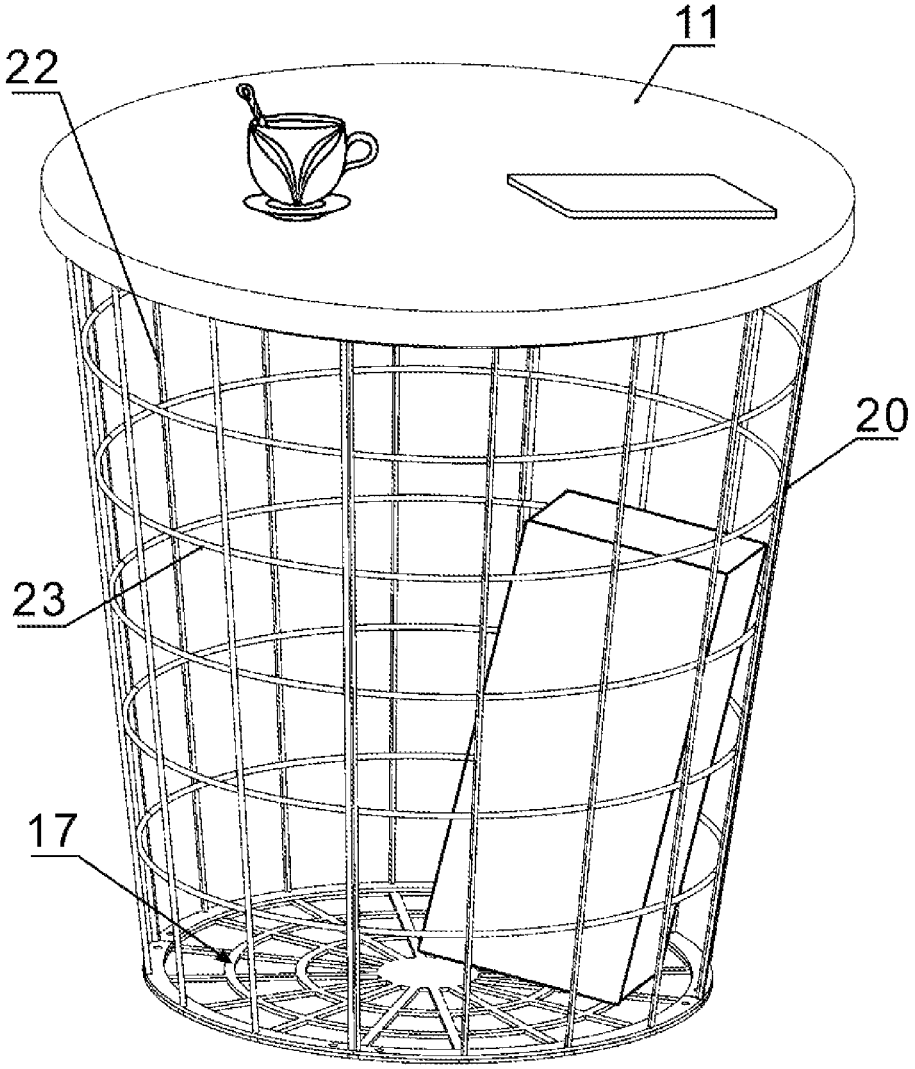
FIG. 1 is a schematic diagram of use according to an embodiment of the present invention.
Figure 2:
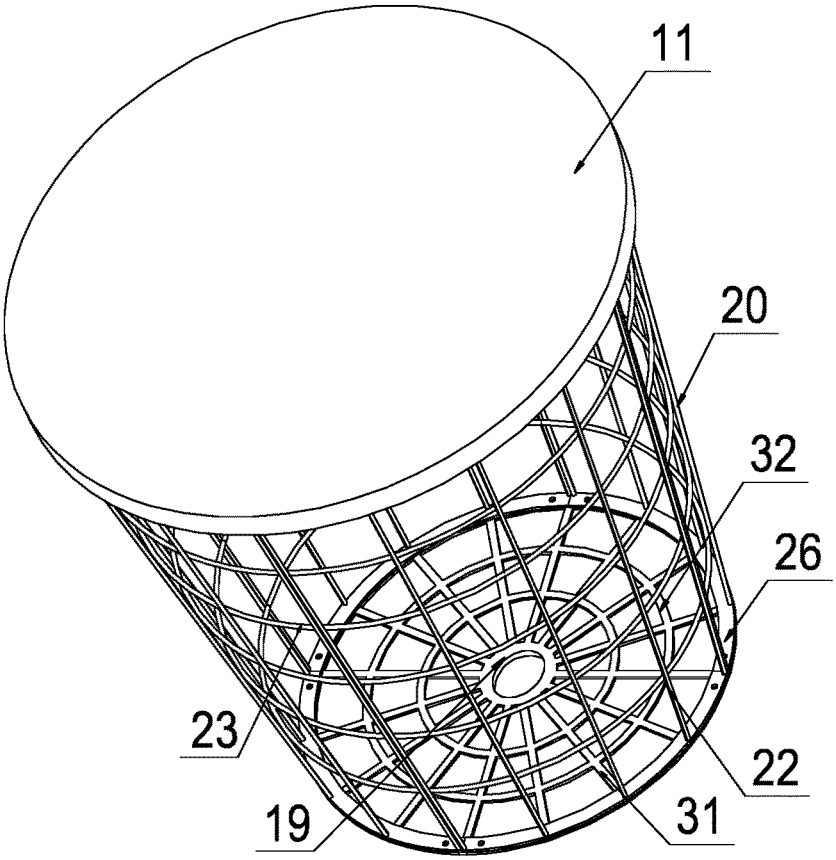
FIG. 2 is a schematic diagram according to Embodiment One of the present invention.

Referring to the accompanying drawings, a multifunctional coffee table of the present invention includes a table top 11. Several immediately adjacent frames 20 are disposed under the table top 11 to form a cylindrical frame body. A base 17 is disposed at the bottom of the frames 20, and a fixing ring 15 is disposed on the top of the frames. The perimeter of the fixing ring 15 is greater than that of the base 17. The fixing ring 15 is located between the table top 11 and the frames 20. The frames 20 are mountably connected with the base 17 and with the fixing ring 15. The table top 11 covers the fixing ring 15.

The frames 20 includes guard bars 22, transverse bars 23, a top plate 25, and a bottom plate 26, wherein the length of the top plate 25 is greater than that of the bottom plate 26. One or more longitudinally arranged guard bars 22 are disposed between the top plate 25 and the bottom plate 26, both ends of the guard bars 22 are disposed on the top plate 25 and the bottom plate 26 respectively, the guard bars 22 incline outwards and extend upwards from the bottom plate 26, and the inclination angle A of the guard bars 22 on the plane where the top plate 25 is disposed is an acute angle.

One or more transversely arranged transverse bars 23 are disposed between the top plate 25 and the bottom plate 26. The transverse bars 23 are arranged to be parallel with the top plate 25 and the bottom plate 26 and disposed on the guard bars 22.

The housing formed by the frames 20 is a drum type housing, truncated cone frame body or trapezoidal table frame body.

In another embodiment, the housing formed by the frames 20 is a truncated cone frame body or trapezoidal table frame body. Sidebars 27 are disposed between ends of the top plate 25 and the bottom plate 26 of the frames 20 and connect both ends of the top plate 25 and the bottom plate 26. The inclination angle of the sidebars 27 on the plane where the top plate 25 is disposed is an acute angle. The top plate 25 and the bottom plate 26 of the frames and the sidebars 27 at both ends constitute a trapezoidal frame (a front projection).

A table top 11 is disposed on the top of the frames 20, and a downward cover ring 12 is disposed on a bottom surface of the table top 11. An inner wall of the cover ring 12 is larger than an outer wall of the cylindrical frame body formed by the frames 20, and the inner wall of the cover ring 12 of the table top 11 is immediately adjacent to the fixing ring 15 and the top of the frame 20. The base 17 has a central bottom shoe 19 to form a plane and at least two uniformly distributed bottom rings 32 formed outside the central bottom shoe 19. There are several uniformly distributed radial supporting bars 31 disposed between the bottom ring 32 of the outermost end of the base 17 and the central bottom shoe 19. The central bottom shoe 19, the supporting bars 31, and the bottom ring 32 of the base 17 are disposed on the same plane.

Embodiment One: Referring to FIG. 2~FIG. 7, the cylindrical frame body is a truncated cone frame body, the table top 11 is circular, and several immediately adjacent circular-arc frames 20 are disposed under the table top 11 and constitute a truncated cone frame body. The length of the inner wall of the cover ring 12 is greater than that of the outer wall of the top of the truncated cone frame body formed by the frames 20. A circular base 17 is disposed at the bottom of the frames 20. The frames 20 include guard bars 22, transverse bars 23, a top plate 25, and a bottom plate 26, wherein the top plate 25 and the bottom plate 26 are arc-shaped and have the same central angle, and the radian length of the top plate 25 is greater than that of the bottom plate 26. Several longitudinally arranged guard bars 22 are disposed between the top plate 25 and the bottom plate 26, and both ends of the guard bars are disposed on the top plate 25 and the bottom plate 26 respectively.

Several transversely arranged transverse bars 23 are disposed between the top plate 25 and the bottom plate 26. The transverse bars 23 are arranged to be parallel with the top plate 25 and the bottom plate 26, disposed horizontally and transversely on the guard bars 22 and form a mesh structure in the shape of # with the guard bars 22. The inclination angle of the guard bars 22 on the plane where the top plate 25 is disposed is an acute angle. The section of the truncated cone frame body formed by the frames 20 is a trapezoidal cone.

3 immediately adjacent circular-arc frames 20 are disposed under the table top 11, and at this point, the central angle of the circular-arc frames 20 is 120°. Or 4 immediately adjacent circular-arc frames 20 are disposed under the table top 11, and at this point, the central angle of the circular-are frames 20 is 90°.

A downward cover ring 12 is disposed at an outer side of the table top 11, the inner diameter of the cover ring 12 is greater than the outer diameter of the truncated cone frame body formed by the frames 20, the table top 11 covers the frames 20, and an inner wall of the cover ring 12 of the table top 11 is immediately adjacent to the top of the frames 20.

Figure 12:
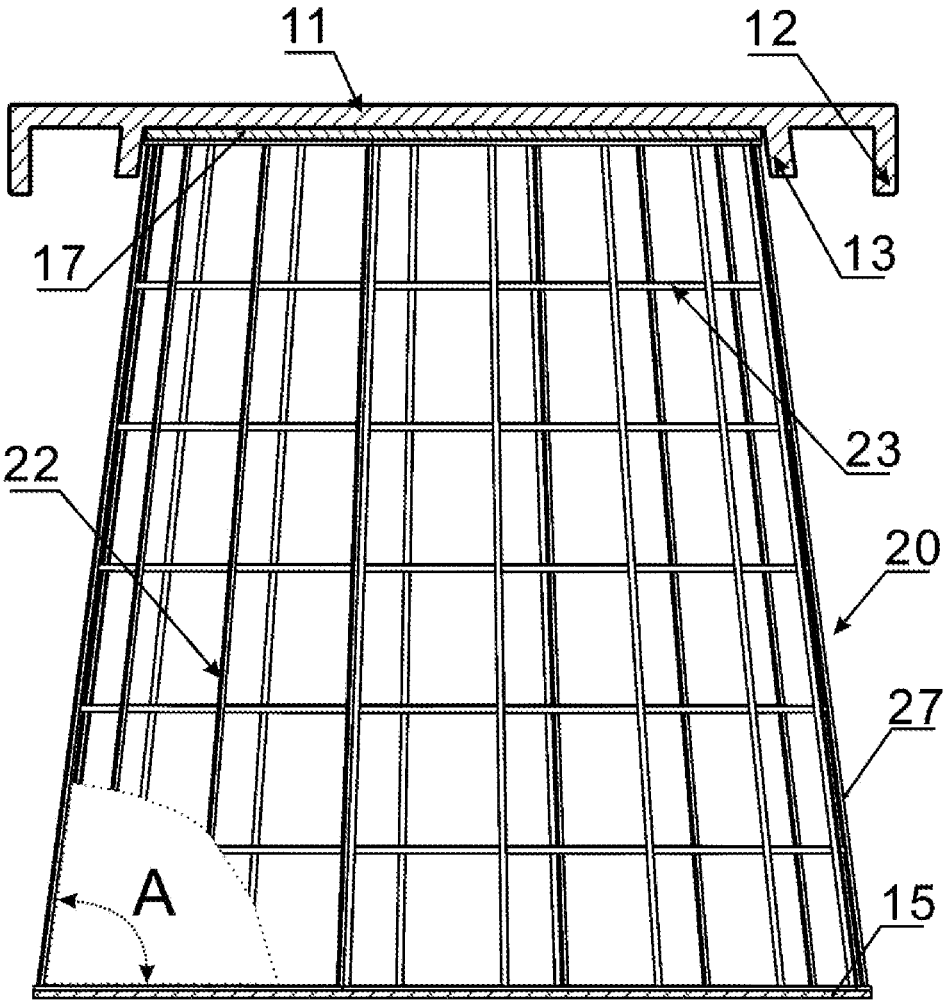
FIG. 12 is a schematic diagram of inverted use of a housing according to an embodiment of the present invention.

The inclination angle A of the guard bars 22 on the plane where the top plate 25 is disposed is 77°~86°, and preferably, the inclination angle A of the guard bars 22 on the plane where the top plate 25 is disposed is 83°. Reference is made to FIG. 12.

The circular base 17 has a central bottom shoe 19 to form a plane and at least two uniformly distributed bottom rings 32 formed outside the central bottom shoe 19. The base 17 and the central bottom shoe 19 (a plate or circle) are both circular. Several uniformly distributed radial supporting bars 31 are disposed between the bottom ring 32 of the outermost end of the base 17 and the central bottom shoe 19. The central bottom shoe, the supporting bars 31, and the bottom ring 32 of the base 17 are disposed on the same plane. The central bottom shoe 19 is a circular plate, a circle, or a circular ring.

The size of the coffee table is 35~45 centimeter (diameter)×38~52 centimeter (height), and the base 17 includes 3~4 uniformly distributed bottom rings 32 and 10~18 uniformly distributed supporting bars 31.

Figure 3:
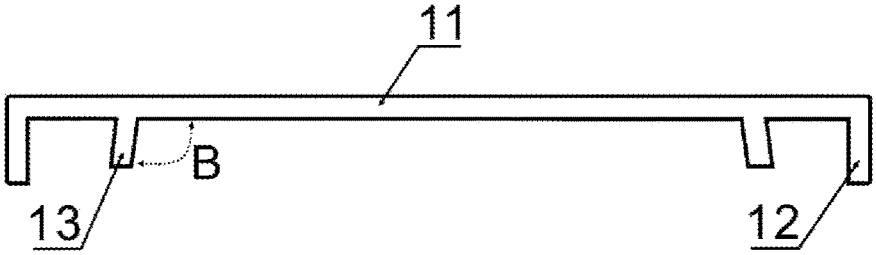
FIG. 3 is a schematic sectional view of a table top according to Embodiment One of the present invention.
Figure 4:
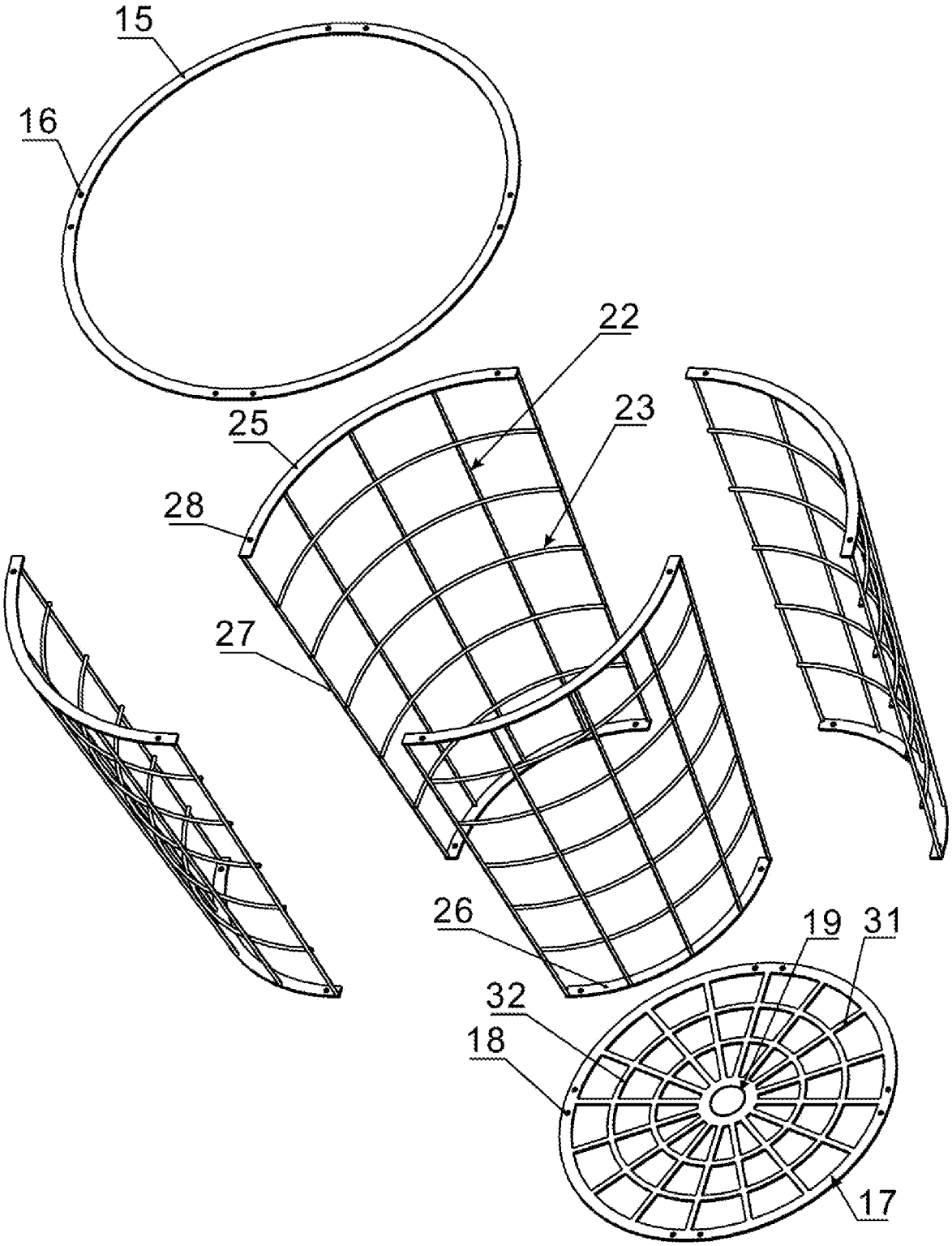
FIG. 4 is a schematic exploded diagram according to Embodiment One of the present invention.
Figure 5:
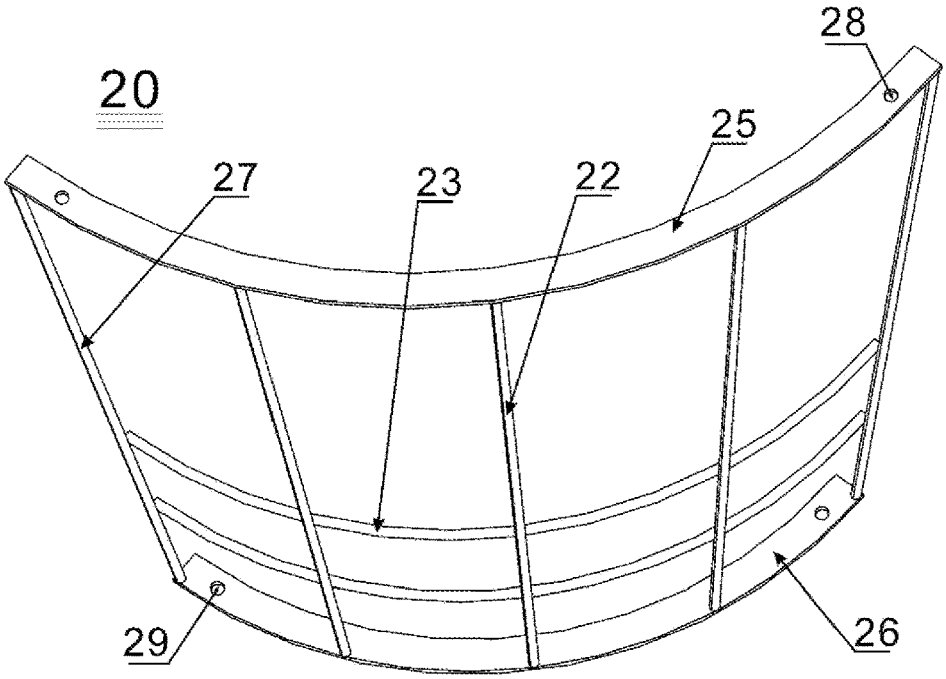
FIG. 5 is a schematic top diagram of a frame according to Embodiment One of the present invention.
Figure 6:
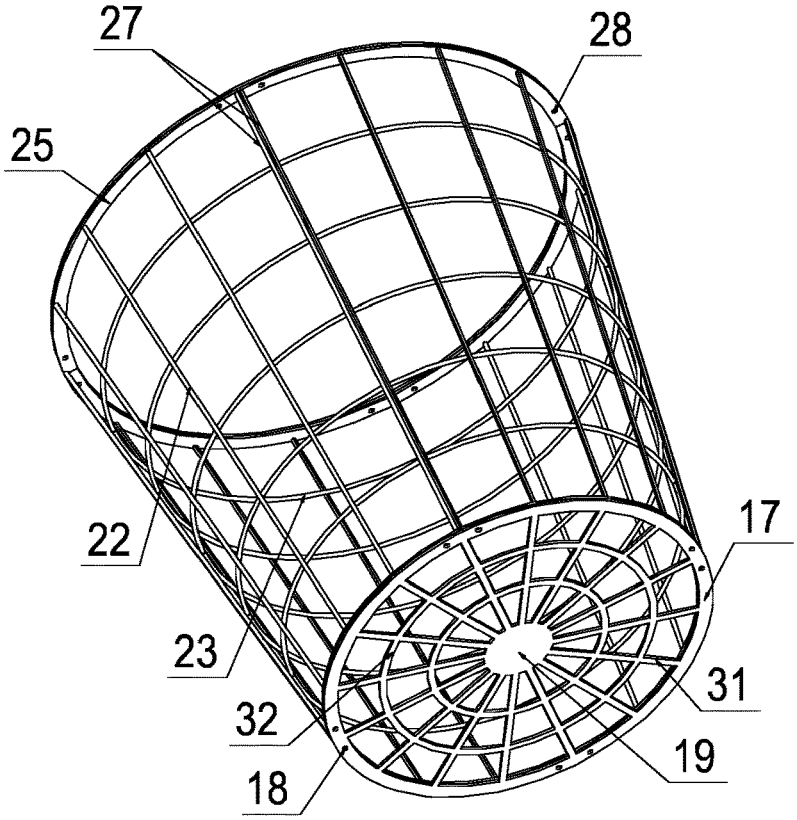
FIG. 6 is a stereoscopic schematic diagram of a housing according to Embodiment One of the present invention.

In another embodiment, an inner snap ring plate 13, which inclines downwards is disposed under the table top 11. Referring to FIG. 3, the side length of the inner snap ring plate 13 is less than that of the cover ring 12, and the cover ring 12 and the inner snap ring plate 13 form a monolithic annular bar. The side length of the inner snap ring plate 13 is greater than that of the base 17, and an obtuse angle is formed by an inner side of the inner snap ring plate 13 and the bottom surface of the table top 11.

The included angle B between the inner side of the inner snap ring plate 13 and the bottom surface of the table top 11 is 94°~103°, and preferably, the included angle B between an inner side 1 of the inner snap ring plate 13 and the bottom surface of the table top 11 is 97'. For innovative visual effects, the frames 20 can be used in an inverted manner. When the frames 20 are placed in an inverted manner, the inner snap ring plate 13 of the table top 11 just covers the base 17 and the bottom plate 26 of the frames 20, and the inner wall of the inner snap ring plate 13 is immediately adjacent to the outer side of the base 17, matched with the inclination angle of the outer side of the guard bar 22 and abuts against the outer side of the frames 20. As such, the coffee table may be used in a stable manner as well, creating morphologic diversity for the whole coffee table.

In another embodiment, sidebars 27 (side levers) are disposed between ends of the top plate 25 and the bottom plate 26 of the frames 20. The sidebars 27 connect both ends of the top plate 25 and the bottom plate 26. Immediately adjacent frames 20 may constitute a truncated cone frame body even without sidebars 27 to save materials.

The inclination angles between the sidebars 27 and the guard bars 22 are the same, the inclination angle A between the sidebars 27 and the plane where the top plate 25 is disposed is 77°~86°, and preferably, the inclination angle A of the sidebars 27 on the plane where the top plate 25 is disposed is 83°. Reference cava be made to FIG. 12.

Figure 7:
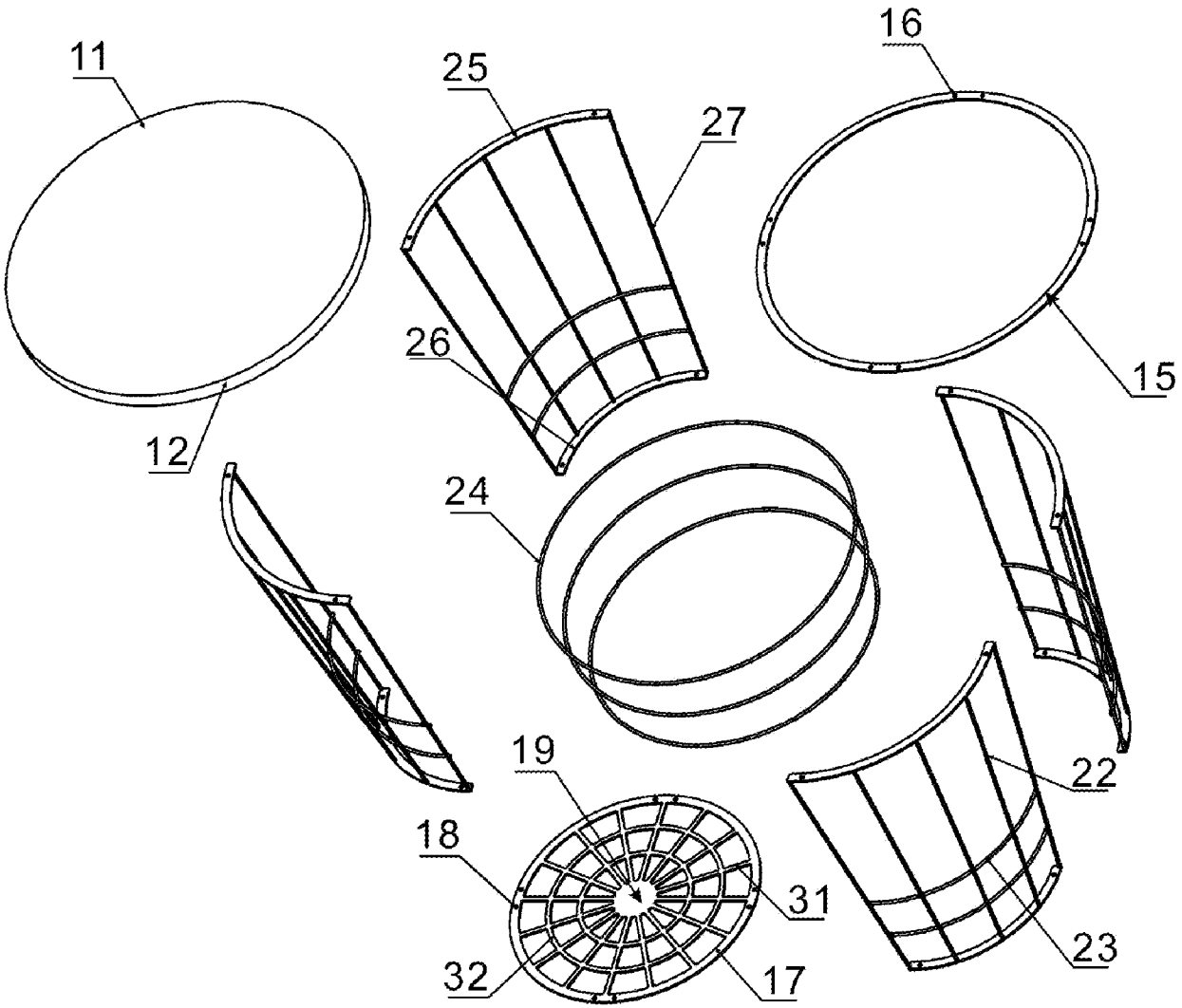
FIG. 7 is a schematic diagram of mounting according to Embodiment One of the present invention.

In another embodiment, two or three transverse bars 23 are disposed only at a lower portion of the frames 20. Referring to FIG. 7, an upper portion of the truncated cone frame body formed by the circular-arc frames 20 is provided with 2~3 uniformly distributed circles 24, diameters of the circles 24 within the truncated cone frame body change gradually, and the circles 24 abut against an inner side of the guard bar 22. That is, an upper portion of the truncated cone frame body formed by the frames 20 is provided with 2~3 circles 24 with gradually increasing diameters, and the circles 24 immediately contact the inner side of the guard bars 22 and uniformly distributed at the upper portion of the truncated cone frame body to improve stability and facilitate mounting and transportation.

In another embodiment, the cover ring 12 and the inner snap ring plate 13 may also be formed by several bumps separated from each other on an annulus. For example, the cover ring 12 and the inner snap ring plate 13 are formed by 3~8 bumps (bosses) uniformly distributed on an annulus.

When the frames 20 are placed in an inverted manner, the inner snap ring plate 13 of the table top 11 just covers (bulks) the base 17 and the bottom plate 26 of the frames 20, and the inner wall of the inner snap ring plate 13 is immediately adjacent to the outer side of the base 17, matched with the inclination angle of the outer side of the guard bar 22 and abuts against the outer side of the frames 20. As such, the coffee table is multifunctional to innovate visual effects.

In another embodiment, the fixing ring 15, the base 17 and the frames 20 are made of metal materials, while the table top 11 is made of composite boards, plastic materials or woods.

To facilitate packaging, transportation, and mounting, the bottom ring 32 of an outer end of the base 17 is provided with several second mounting holes 18, the bottom plate 26 is provided with fourth mounting holes 29 matched with the second mounting holes 18, the fixing ring 15 is provided with several first mounting holes 16, and the top plate 25 is provided with third mounting holes 28 matched with the first mounting holes 16. During mounting, the frames 20 are placed on the base 17 first, both of which are fixed by fasteners through the fourth mounting holes 29 and the base 17, connecting the frames 20 and the base 17 fixedly; and then, the fixing ring 15 is placed on the top plate 25, both of which are fixed by fasteners through the first mounting holes 16 and the third mounting holes 28, connecting the frames 20 and the fixing ring 15 fixedly. At this point, the mounting of whole storage frame is complete. The coffee table can be used after the table top 11 is covered on the storage frame.

Figure 13:
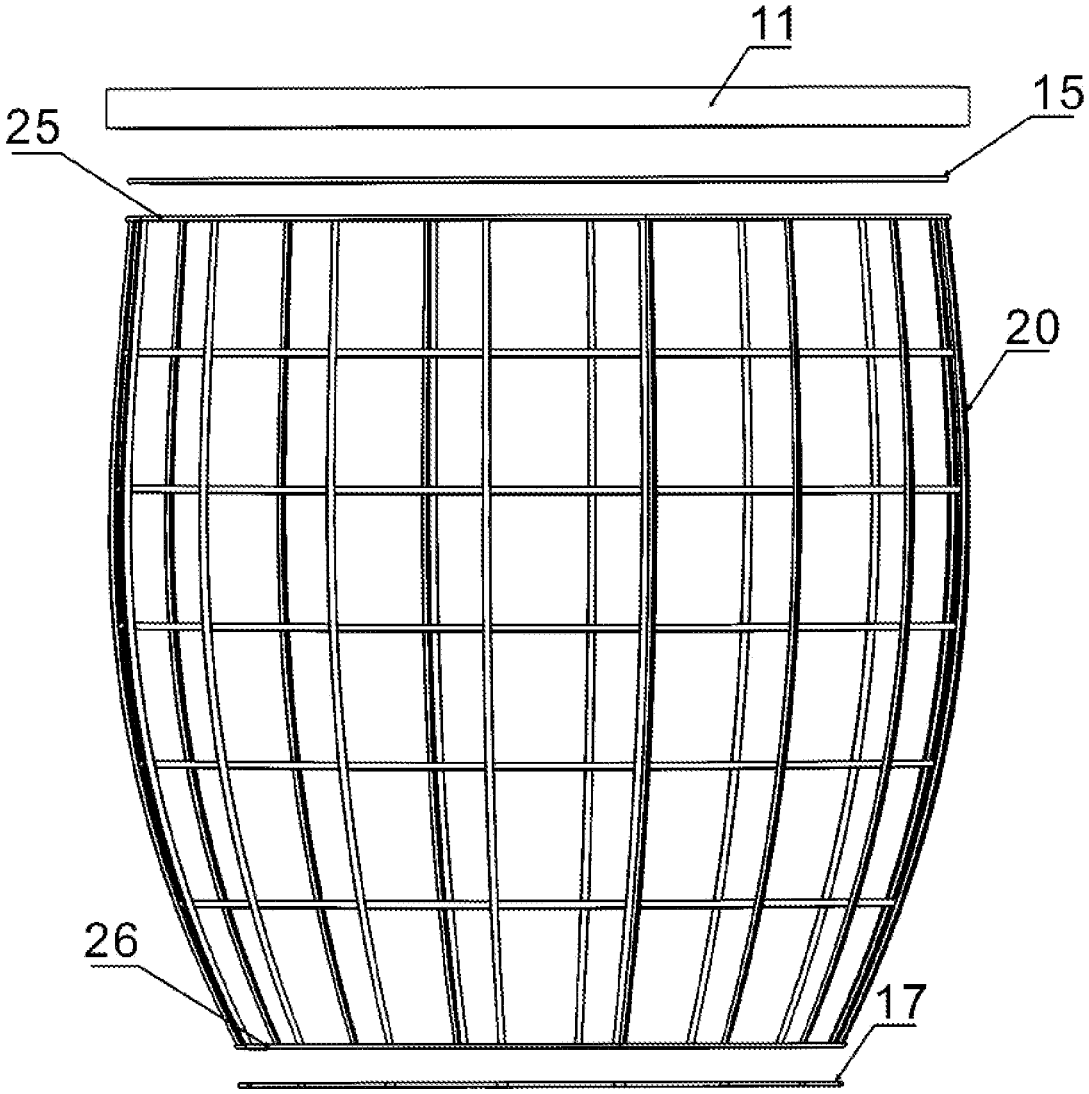
FIG. 13 is a schematic structural diagram according to another embodiment of the present invention.

In another embodiment, the housing formed by the frames 20 is a drum type housing. Referring to FIG. 13, the guard bars 22 and the sidebars 27 are arc-shaped then.

Figure 8:
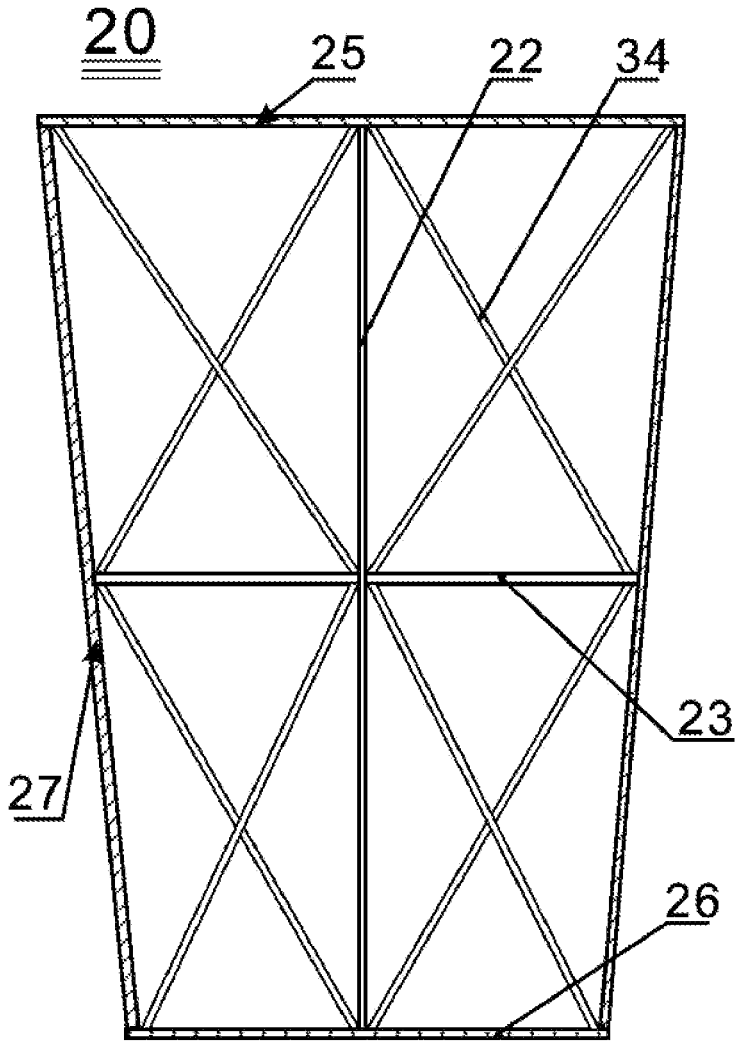
FIG. 8 is a schematic structural diagram of a frame according to Embodiment Two of the present invention.
Figure 9:
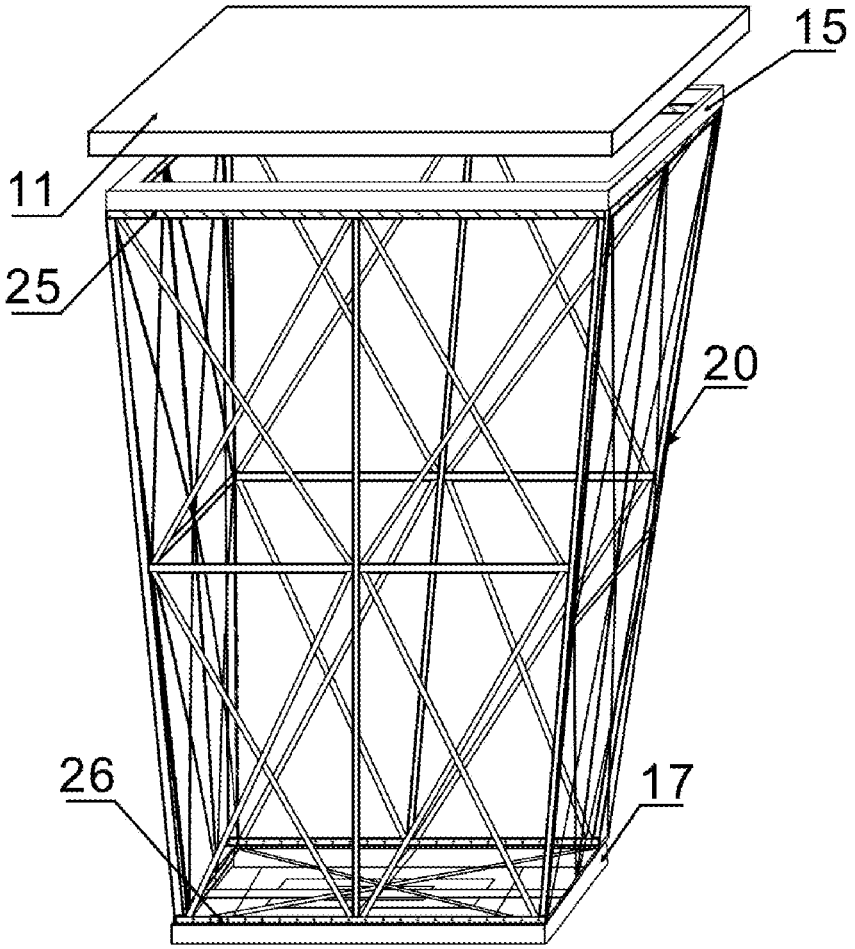
FIG. 9 is a stereoscopic schematic diagram according to Embodiment Two of the present invention.

Embodiment Two: Referring to FIG. 8 and FIG. 9, the fixing ring 15 and the base 17 are square, the central bottom shoe 19 is a square ring or square plate, the top plate 25, the sidebar 27, the bottom plate 26, and the guard bar 22 constitute a right trapezoid, within which two connecting bars 34 intersected are disposed, and four endpoints of the crossed bars 34 connect four corners of the right trapezoid.

Figure 10:
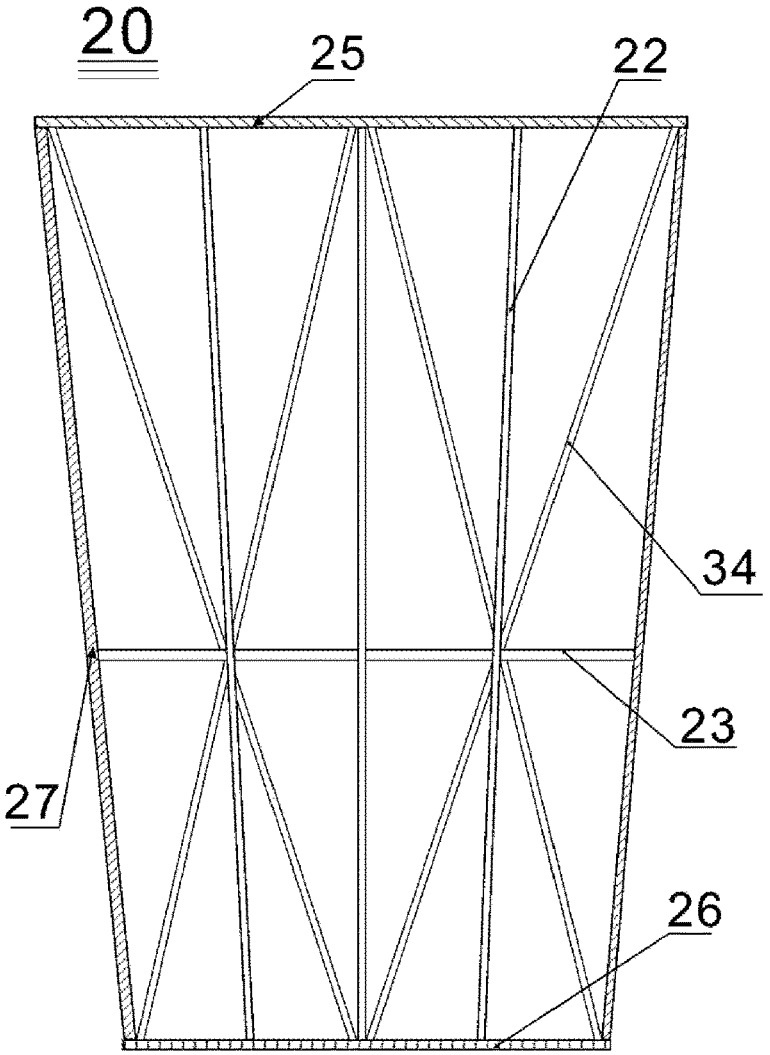
FIG. 10 is a schematic structural diagram of a frame according to Embodiment Three of the present Invention.

Embodiment Three: Referring to FIG. 10, the fixing ring 15 and the base 17 are square, the central bottom shoe 19 is a square ring or square plate, the top plate 25, the sidebar 27, the bottom plate 26, and the guard bar 22 constitute a right trapezoid, within which two connecting bars 34 intersected are disposed, the crossing point of the two connecting bars 34 is disposed on the transverse bar 23, and a planar projection of the frame is a rhombus.

Figure 11:
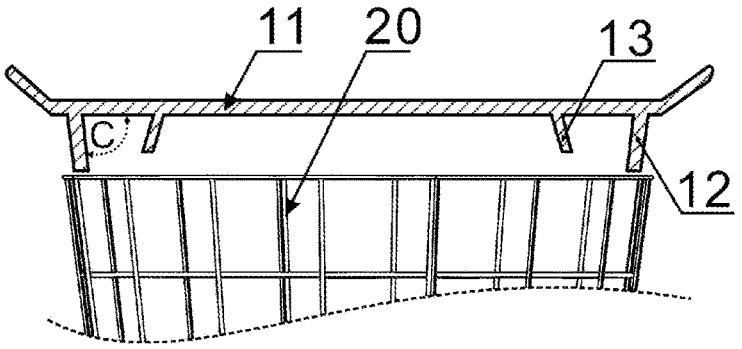
FIG. 11 is a schematic structural diagram of a table top according to Embodiment Four of the present invention.

Embodiment Four: Referring to FIG. 11, an outer side of the table top 11 is provided with a horn type retainer that warps upwards, a cover ring 12 that inclines downwards is disposed under the table top 11, the outer diameter of the cover ring 12 is less than the inner diameter of the fixing ring 15 and also the inner diameter of the top of the truncated cone frame body formed by the frames 20, and an acute angle is formed by an inner wall of the cover ring 12 and the bottom surface of the table top 11.

Further, the included angle C between the inner wall of the cover ring 12 and the bottom surface of the table top 11 is 77°~86°, and preferably, the included angle C between the inner wall of the cover ring 12 and the bottom surface of the table top 11 is 83°. The table top 11 covers the frames 20. An outer wall of the cover ring 12 of the table top 11 is immediately adjacent to the inner wall of the fixing ring 15 and abuts against the inner side of the frame 20. The inner snap ring plate 13, which inclines downwards and has a diameter less than that of the cover ring 12, is disposed under the table top 11, and an obtuse angle is formed by the inner side of the inner snap ring plate 13 and the bottom surface of the table top 11.

Further, the included angle B between the inner side of the inner snap ring plate 13 and the bottom surface of the table top 11 is 94°~103°, and preferably, the included angle B between the inner wall of the inner snap ring plate 13 and the bottom surface of the table top 11 is 97°. The configuration of the inner snap ring plate 13 facilitates inverting the frames 20 for use.

In the present invention, a storage frame or collection basket is formed by the frames 20, the base 17, and the fixing ring 15. Wood grains of the detachable table top 11 and the metal grid storage frame or collection basket are combined into a coffee table. During the packaging and transportation of products, the separated frames 20, the table top 11, the base 11, and the fixing ring 15 are placed in a stacked manner to reduce the space occupied by the products and facilitate storage and logistics.

Coffee tables are important furniture. The improved coffee table of the present invention is in light weight, has small volume in packaging and transportation, has a storage frame or storage basket made of durable metal, lightweight, and portable, and therefore can be easily moved at any time. The coffee table of the present invention can be placed on chairs, sofas in living room or beside tables in bedroom as a modern decoration to add new styles for home.

What is claimed is:

1. A multifunctional coffee table, comprising a table top, wherein several immediately adjacent frames are disposed under the table top to form a cylindrical frame body, wherein a base is disposed at a bottom of the frames, and a fixing ring is disposed on a top of the frames and located between the table top and the frames, the fixing ring being larger than the base;

the frames are mountably connected with the base and with the fixing ring, the table top covering the fixing ring;

the frames include guard bars, transverse bars, a top plate, and a bottom plate, wherein the top plate is longer than the bottom plate, one or more longitudinally arranged guard bars are disposed between the top plate and the bottom plate, both ends of the guard bars are disposed on the top plate and the bottom plate respectively, the guard bars incline outwards and extend upwards from the bottom plate, and the inclination angle of the guard bars on the plane where the top plate is disposed is an acute angle; and one or more transversely arranged transverse bars are disposed between the top plate and the bottom plate, the transverse bars being arranged to be parallel with the top plate and the bottom plate and disposed on the guard bars.

2. The multifunctional coffee table according to claim 1, wherein the frame body formed by the frames is a truncated cone frame body or trapezoidal table frame body;

sidebars are disposed between ends of the top plate and the bottom plate of the frames, wherein the sidebars connect both ends of the top plate and the bottom plate, the inclination angle of the sidebars on the plane where the top plate is disposed is an acute angle, and the top plate and the bottom plate of the frame and the sidebars at both ends are trapezoidal-shaped;

the table top is disposed on the top of the frames, wherein a downward cover ring is disposed on a bottom surface of the table top, and the cover ring of the table top is immediately adjacent to the fixing ring and the top of the frames; and the base has a central bottom shoe to form a plane and at least two uniformly distributed bottom rings formed outside the central bottom shoe, wherein several uniformly distributed radial supporting bars are disposed between the bottom ring of the outermost end of the base and the central bottom shoe, and the central bottom shoe, the supporting bars, and the bottom ring of the base are disposed on the same plane.

3. The multifunctional coffee table according to claim 2, wherein the truncated cone frame body formed by the frames is trapezoidal, an inner wall of the cover ring is larger than an outer wall of the top of the cylindrical frame body formed by the frames, and the inner wall of the cover ring of the table top is immediately adjacent to the fixing ring and the top of the frames;

the top plate and the bottom plate are arc-shaped and have the same central angle, the radian length of the top plate is greater than that of the bottom plate, and the inclination angle of the sidebars on the plane where the top plate is disposed is 77°~86°; and planar projections of the transverse bars, the guard bars, and the sidebars are in mesh shape, the fixing ring and the base are circular, and the central bottom shoe is a circular ring or circular plate.

4. The multifunctional coffee table according to claim 2, wherein the fixing ring and the base are square, the central bottom shoe is a square ring or square plate, the top plate, the sidebar, the transverse bar, and the guard bar constitute a right trapezoid, within which two connecting bars intersected are disposed, and four endpoints of the crossed connecting bars connect four corners of the right trapezoid.

5. The multifunctional coffee table according to claim 2, wherein the fixing ring and the base are square, the central bottom shoe is a square ring or square plate, the top plate, the sidebar, the bottom plate, and the guard bar constitute a right trapezoid, within which two intersecting connecting bars are disposed, four endpoints of the two connecting bars connect four corners of the right trapezoid, and the crossing point of the two connecting bars is disposed on the transverse bar.

6. The multifunctional coffee table according to claim 2, wherein an outer side of the table top is provided with a retainer that warps upwards, the cover ring of the bottom surface of the table top inclines downwards, the cover ring is smaller than the fixing ring, the perimeter of the cover ring is less than that of the top of the truncated cone frame body formed by the frames as well, and an acute angle is formed by an inner wall of the cover ring and the bottom surface of the table top.

7. The multifunctional coffee table according to claim 6, wherein an inner snap ring plate, which inclines downwards and smaller than the cover ring, is disposed under the table top, and an obtuse angle is formed by the inner side of the inner snap ring plate and the bottom surface of the table top;

an included angle between the inner wall of the cover ring and the bottom surface of the table top is 77°~86°, and the cover ring and the inner snap ring plate are several bumps separated from each other on an annulus; and a lower portion of the frame is provided with one to three transverse bars, an upper portion of the truncated cone frame body formed by the circular-arc frames is provided with 1~3 uniformly distributed circles, the diameters of the circles within the truncated cone frame body change gradually, and the circles abut against an inner side of the guard bar and are uniformly distributed inside the upper portion of the truncated cone frame body formed by the frames.

8. The multifunctional coffee table according to claim 1, wherein a bottom ring of an outer end of the base is provided with several second mounting holes, the bottom plate is provided with fourth mounting holes matched with the second mounting holes, the fixing ring is provided with several first mounting holes, and the top plate is provided with third mounting holes matched with the first mounting holes.

9. The multifunctional coffee table according to claim 1, wherein a bottom surface of the table top is provided with an inner snap ring plate, which inclines downwards and is smaller than the cover ring but larger than the base, and an obtuse angle is formed by an inner side of the inner snap ring plate and the bottom surface of the table top.

10. The multifunctional coffee table according to claim 9, wherein the inclination angle of the guard bars on the plane where the top plate is disposed is 77°~86°;

an included angle between the inner side of the inner snap ring plate and the bottom surface of the table top is 94°~103°;

3 or 4 immediately adjacent circular-arc frames are disposed under the table top, and the central angle of the circular-arc frames is 120° or 90°; and the base includes 3~4 uniformly distributed bottom rings and 10~18 uniformly distributed supporting bars.

* * * * *